United States Patent [19]

Corboud

[11] 3,956,911

[45] May 18, 1976

[54] LOCK FOR RUNNERS, PARTICULARLY RUNNERS OF SLIDING GLASS DOORS, ON DISPLAY-WINDOW CASES

[75] Inventor: Gérard Carboud, Hahnwald, Germany

[73] Assignee: Firma Josef Voss KG., Bruhl, Bezirk Cologne, Germany

[22] Filed: Sept. 14, 1973

[21] Appl. No.: 397,277

[30] Foreign Application Priority Data

June 20, 1973 Germany ..... 2331369

[52] U.S. Cl. ..... 70/100; 70/81; 70/90; 70/131; 292/62; 292/DIG. 46

[51] Int. Cl.[2] ..... E05B 65/08; E05C 5/02

[58] Field of Search ..... 70/81, 90, 100, 131; 292/59, 62

[56] References Cited

UNITED STATES PATENTS

| | | | |
|---|---|---|---|
| 365,679 | 6/1887 | Gantenberg | 292/62 |
| 559,982 | 5/1896 | Madison | 70/90 |
| 1,418,290 | 6/1922 | Deeds | 70/352 |
| 2,917,915 | 12/1959 | Rainman | 70/100 |
| 3,397,000 | 8/1968 | Nakanishi | 292/61 |
| 3,798,935 | 3/1974 | Blekking et al. | 70/100 |

*Primary Examiner*—Paul R. Gilliam
*Assistant Examiner*—Carl F. Pietruszka
*Attorney, Agent, or Firm*—Ernest G. Montague; Karl F. Ross; Herbert Dubno

[57] ABSTRACT

A lock for the runners, particularly for runners of sliding glass doors on a display case which comprises a box-like housing including at the front sliding glass doors. A locking bolt is displaceable in axial direction and is adapted to enter into a bolt opening of another overlapping, opposing runner. A locking cylinder is operatively connected with the locking bolt, and a device is arranged for moving the locking bolt from its advanced bolt engagement position into its open position independently of the locking cylinder.

3 Claims, 8 Drawing Figures

FIG. 2
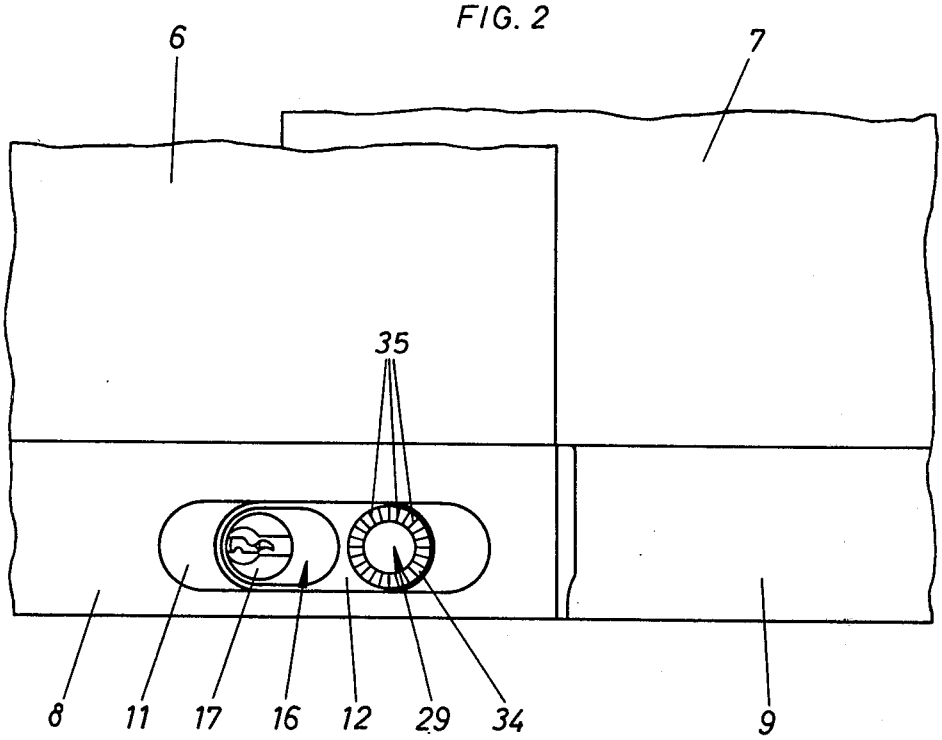
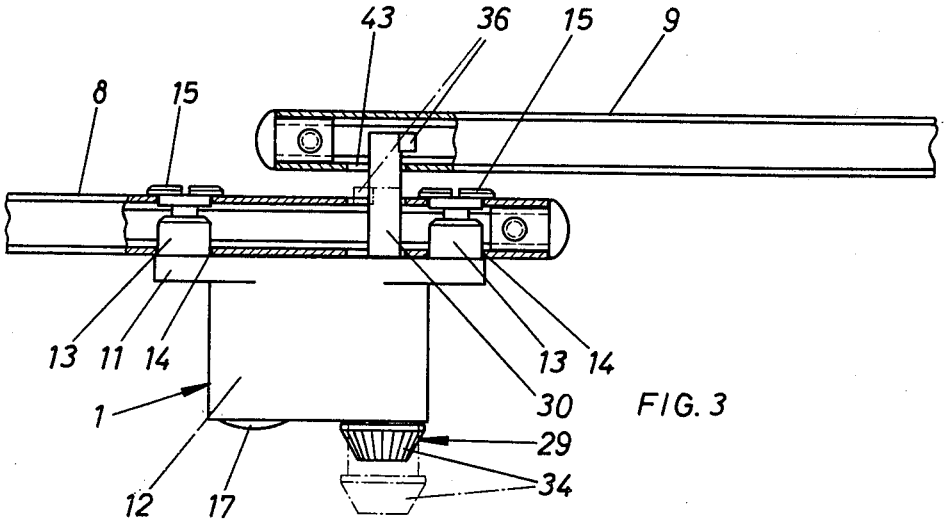
FIG. 3

LOCK FOR RUNNERS, PARTICULARLY RUNNERS OF SLIDING GLASS DOORS, ON DISPLAY-WINDOW CASES

The present invention relates to a lock for runners, particularly those of sliding glass doors or showcase windows, having a locking bolt on a first runner which can be displaced in axial direction and which engages in a bolt opening of another overlapping mating runner and with which a lock cylinder is coordinated.

The one known lock for runners, a lock cylinder and a locking bolt are arranged parallel to one another in a common housing. The latter is fastened to one runner. In the open position of the lock, either with the key engaged in the lock cylinder or removed from it, the locking bolt releases the other runner. From this position the locking bolt can be pressed inwardly by hand in the bolt engagement direction, into a position in which the bolt is locked. The release of the locking bolt can be effected by the key which fits the lock cylinder. This construction has various disadvantages in use. During daytime operation with supervision of the display cases available in a store or office, if the locking bolt is in the locked position, the required key must always be sought out in order to release the locking bolt by means of the lock cylinder. However, if the locking bolt were left continuously in its open position, this could permit possible theft of the articles stored within the showcase even with supervision, since the open position of the locking bolt is obvious. This known development also permits possible misuse by, for instance pressing, the locking bolt without authorization, inwards.

It is one object of the present invention, to provide a lock of a construction which is advantageous in use and designed so that the locking bolt has two bolted positions, namely locked-bolted and apparently locked-bolted, in addition to an unbolted position.

It is another object of the present invention, to provide an improved lock for runners, particularly runners of sliding glass doors, on display window cases, which includes a locking bolt which is displaceable in axial direction and enters into a bolt opening of another overlapping, opposing runner, and has a locking cylinder operatively connected with the locking bolt. Means are also provided for moving the locking bolt from its advanced bolt engagement position into its open position independently of the locking cylinder.

As a result of this development, a lock of this type which is of a construction which is advantageous in use is created. The lock in accordance with the present invention is characterized by three positions of closing (engaged-locked, engaged-unlocked and disengaged). These provide on the one hand the closed or truly locked position (truly locked-bolted), the "apparently bolted" position (apparently locked-bolted), and the open position of the lock. The locking bolt can only be brought out of the closed engaged-locked position (truly locked-bolted) of the lock when the locking bolt is released by means of the key corresponding to the lock cylinder. However, the locking bolt then still remains in an engaged-unlocked position (apparently locked-bolted). To be sure, it is only an "apparently bolted" position. This cannot be recognized from the outside. Only the sales personnel can know that the device is in an unlocked position. In this way it is possible for them to bring the locking bolt, without the use of a key, from this engaged-unlocked or "apparently bolted" (apparently locked-bolted) position into the open position by a simple manipulation. The open or disengaged position is then visible. This provides assurance to a great extent that after the sliding glass doors have been moved together, the sales personnel will not forget to bring the lock into the "apparently locked-bolted" position or the truly locked-bolted position. The parts for the construction of the present invention are simple. They are also trouble-free. The radially protruding lug of the locking bolt fulfills a multiple function: on the one hand it serves as stop for the axial movement of the locking bolt in the direction of release. On the other hand it secures the locking bolt against rotation in its released position. This has the advantage, that when the sliding doors are pushed closed, the stop for the locking bolt can enter unimpeded into the bolt opening corresponding to it. Furthermore, this locking lug secures the "apparently locked bolted" position, in which it rests against the bottom plate of the housing. In addition to this, the locking lug also serves as a stop for the rotation of the locking bolt in cooperation with the locking slide which is actuatable by the lock cylinder. The idle stroke, or lost motion which is provided in the eccentric drive, permits a favorable construction of the lock cylinder with only one position of withdrawal for the key. With the key removed, it can therefore not be noted in the "apparently locked-bolted" position of the lock what position the locking cylinder is in. The possibility of pushing the locking bolt into its "apparently locked bolted" position serves further the purpose of securing the lock. In order to be able to turn the locking bolt at all in this position, it must be pressed inwards by a certain amount. Only after this step can the locking bolt be turned. This fact further impedes unauthorized tampering.

These and other objects will become apparent from the following detailed description of the present invention, reference being made to the accompanying drawing, in which:

FIG. 2 is a top plan view of the lock associated with the one runner;

FIG. 3 is a horizontal section through the lock corresponding to its closed position;

Figure 1:
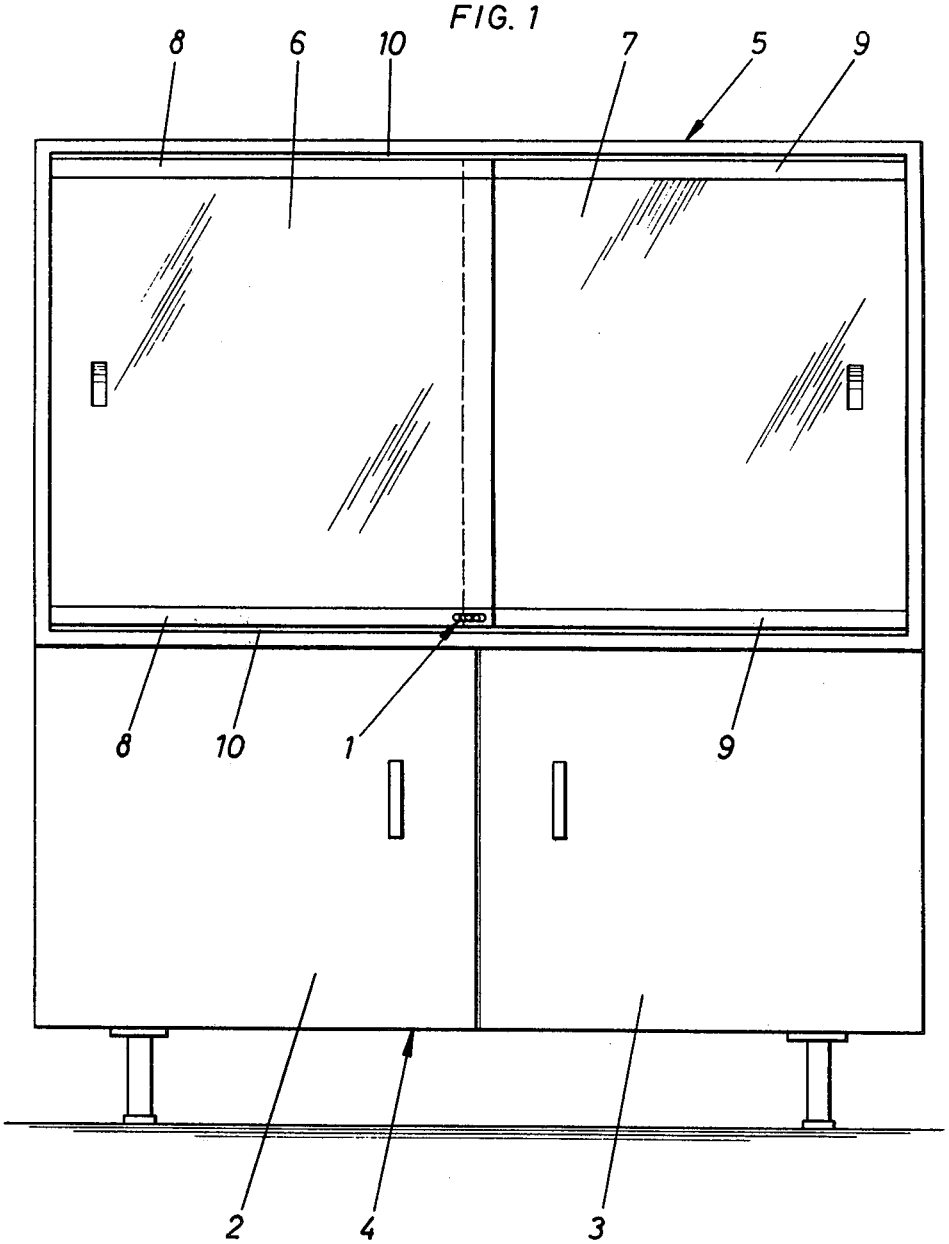
FIG. 1 is a front elevation of a window display case equipped with the lock of the present invention.

Referring now to the drawings, the display case provided with a lock 1, in accordance with the present invention, has a bottom portion 4 provided with doors 2 and 3. On this bottom portion there is located the boxlike housing 5, whose front has sliding glass doors 6 and 7.

Each of the sliding glass doors 6 and 7 is provided with a runner 8 or 9 on its lower horizontal edge. These runners are guided by horizontally directed rails 10 on the box-shaped housing 5. Accordingly two rails 10 lie parallel to one another in one plane. The sliding glass door 6 is guided in the outer rails, while the sliding glass door 7 travels in the inner rails. The sliding glass door 6 is provided with the lock 1. The lock 1 has a casing 12 provided with a bottom plate 11. Pins 13 integral with the bottom plate 11 extend from the latter and enter into holes 14 in the runner 8. The pins 13 are provided with an internal thread, in which screws 15 inserted from the other side of the runner 8 enter and thus secure the housing 12 to the runner 8.

Figure 4:
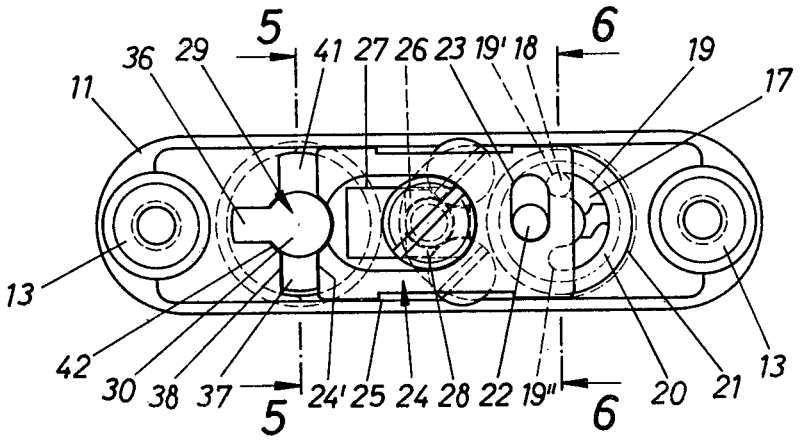
FIG. 4 is a rear elevation of the lock in its closed position.
Figure 5:
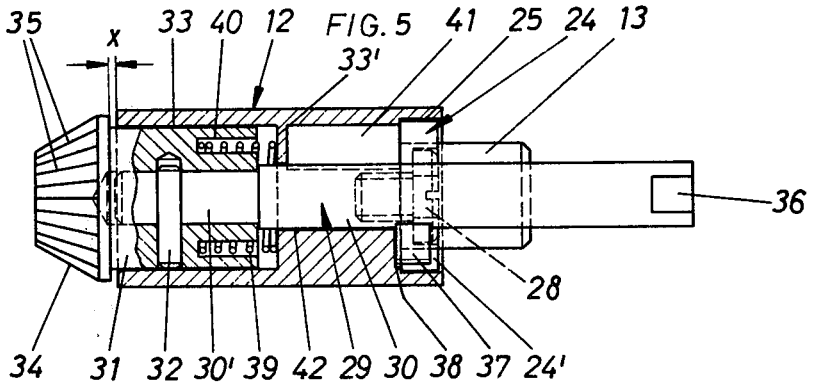
FIG. 5 is a section along the line V—V of FIG. 4.

The one side of the oval housing 12 contains a lock cylinder 16 (FIG. 2). Its cylinder plug 17 bears the driving pin 18 (FIG. 6) on its inner front end. The pin 18 engages into the arcuate slot 19 of the driving disk 20. The driving disk 20 is supported in a bore 21 of the bottom plate 11 of the housing, which bore 21 is concentric to the cylinder plug 17. In the closed position of the lock cylinder, the driving pin 18 extends along the one end 19' of the arcuate slot 19 which covers about 180° (FIG. 4).

The eccentric pin 22 passes from the driving disk 20 symmetrically to the arcuate slot 19. It engages in a longitudinal slot 23 in a locking slide 24. The longitudinal slot 23 extends transversely to the direction of displacement of the locking slide 24. The locking slide 24 is guided in form-locked fashion in a recess 25 in the bottom plate 11. There also serves for the guiding thereof a projection 26 of the bottom plate 11, which projection extends into a recess 25 and engages in a longitudinal slot 27 of the locking slide 24. A collar screw 28 which enters into the thread of the projection 26 prevents the locking slide 24 from falling out of the recess 25.

A locking bolt 29 (FIGS. 6 and 8) is supported in the housing 12 parallel to the lock cylinder 16. It consists of a shank 30, a stepped-down section 30' of which is inserted into a cylindrical body 31. A transverse pin 32 prevents these two parts from turning with respect to each other. The cylindrical body 31 is guided in the supporting bore 33 of the housing 12. The end of the cylindrical body 31 which protrudes beyond the front of the housing forms a frustoconical operating handle 34, the base diameter of which is greater than that of the body 31. In order that it may be gripped better, the outer surface of the operating handle 34 is provided with teeth 35.

Figure 6:
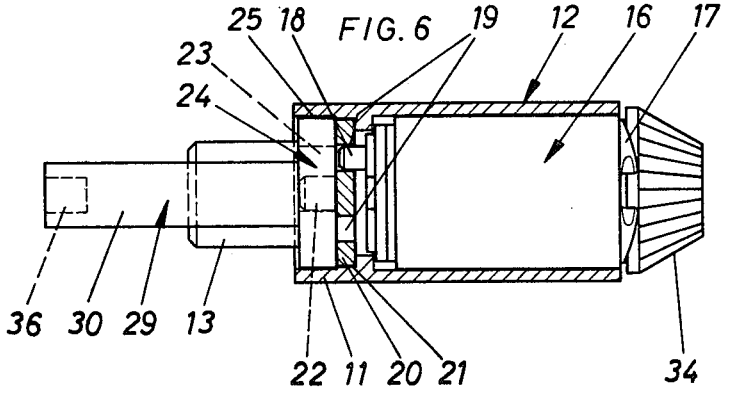
FIG. 6 is a section along the line VI—VI of FIG. 4.
Figure 8:
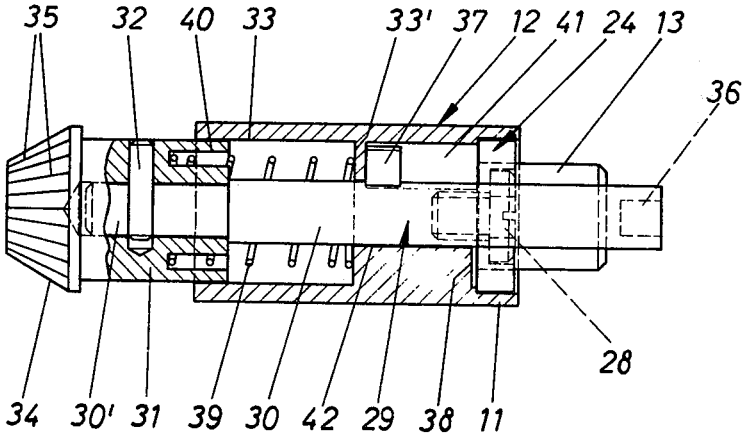
FIG. 8 is a section corresponding to FIG. 5, showing the open position of the lock.

The inner end of the shank 30 of the locking bolt 29 is provided with a closing extension 36. Furthermore, a radially directed locking lug 37 extends from the shank 30. This lug 37 is spaced angularly from the locking extension 36, by an angle of about 90° (FIGS. 3, 6 and 8).

In the bolted position of the locking bolt 29, the locking lug 37 passes, into a detent niche 38 in recess 25 of the housing bottom plate 11 of a shape adapted to it. The depth of the detent niche 38 is less, when the locking bolt is in the bolted position, than the distance $x$ between the base surface of the actuating handle 34 and the front wall of the housing 12. The locking bolt is urged in outward direction by a compression spring 39. This spring enters in part into an annular recess 40 in the body 31 and rests against the bottom of this recess. The other end of the spring rests against the bottom 33' of the bore 33.

Opposite the detent niche 38, there is a channel 41 which extends radially from the bore hole 42 which guides the shank 30 but terminates at a distance from the bore 33.

The device operates as follows: In the closed truly locked-bolted position of the lock, the locking edge 24' of the locking slide 24 is in front of the locking lug 37 of the locking bolt 29 (FIG. 4). Even if the locking bolt 29 should be pressed inwards by the amount $x$, it cannot be turned and the lock remaining secured.

Figure 7:
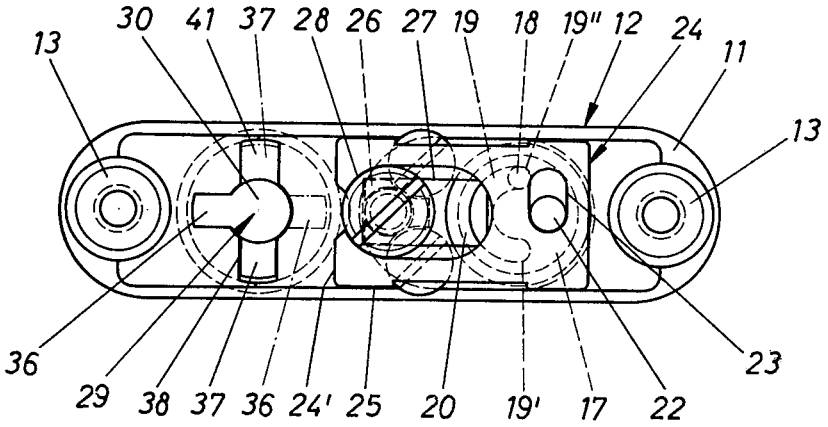
FIG. 7 is an elevation corresponding to FIG. 4, but with the lock in the "apparently bolted" position.

By means of a key corresponding to the lock cylinder, the locking slide 24 can be brought into a releasing position (FIG. 7). Upon the locking rotation of the cylinder plug 17, its driving pin 18 travels idly for an amount corresponding to the angle of the arcuate slot 19. Only upon reaching the other end 19'' of the arcuate slot 19, does the driving pin 18, carry the driving disk 20 along with it, the latter displacing the locking slide by means of its pin 22. The locking slide then passes into the position shown in FIG. 7. After one complete locking rotation of the cylinder plug, the key can be withdrawn. This means that there is only one key-withdrawal position. The closing rotation of the cylinder plug is limited by suitable dimensioning of the longitudinal slot 23 of the locking slide 24. The position in accordance with FIG. 7 shows the "apparently bolted" position. The locking bolt 29 is still in its closed position (engaged-unlocked). If the released (disengaged) position of the locking bolt 29 is now to be brought about, the latter must be pressed inwards by means of the actuating handle 34 by about the distance $x$ so that the locking lug 37 emerges from the detent niche 38. Thereupon the locking bolt can be turned through about 180° and thereby passes into alignment with the channel 41. The compression spring 39 can in this way displace the locking bolt in outward direction, into the dot-dash position shown in FIG. 3. The end of the locking bolt 29 on its locking side in this connection brings its closing extension 36 out of the bolt opening 43 of the other runner 9.

If, for instance, from this position only the "apparently bolted" position is to be produced, it is merely necessary to push the locking bolt 29 inwardly and turn it through about 280° until the locking lug 37 engages in the corresponding detent niche 38.

I claim:

1. A lock for sliding doors comprising:

a housing mounted on one of said doors and having an opening alignable with a bore provided in the other of said doors;

a bolt receivable in said housing in line with said opening and receivable in said bore, said bolt being rotatable in said housing and axially shiftable therein while being provided with a lateral locking projection;

means in said housing forming an abutment for said projection restraining said bolt from axial withdrawal from said bore in one angular position of said bolt and permitting axial withdrawal in another angular position of said bolt;

a locking slide shiftable in said housing transversely of said bolt and engageable in one position of said slide with said projection for preventing rotation thereof while permitting such rotation in another position of said slide;

a locking cylinder mounted in said housing parallel to said bolt and adapted to receive a key, said cylinder being rotatable to shift said slide; and an actuating handle on said bolt operable from the exterior of said housing to rotate said bolt and selectively engage said projection with said abutment and release said projection from said abutment.

2. The lock defined in claim 1, further comprising an eccentric drive between said cylinder and said slide adapted to allow angular loss motion of said cylinder through about 180° between the drive of said cylinder and said slide.

3. The lock defined in claim 1, further comprising a detent for retaining said bolt in at least one of its angular positions, said abutment being formed by a bottom plate of said housing, said bolt being axially shiftable upon engagement of said projection by said bottom plate in an amount equal to the depth of engagement of the detent.

* * * * *